US009624934B2

(12) United States Patent
Parker

(10) Patent No.: US 9,624,934 B2
(45) Date of Patent: Apr. 18, 2017

(54) AIR COOLING SYSTEM FOR A TURBOCHARGER DRIVEN GENERATOR

(71) Applicant: Cummins Ltd., Huddersfield (GB)

(72) Inventor: John F Parker, Huddersfield (GB)

(73) Assignee: Cummins Ltd., Huddersfield (GB)

( * ) Notice: Subject to any disclaimer, the term of this patent is extended or adjusted under 35 U.S.C. 154(b) by 282 days.

(21) Appl. No.: 13/688,808

(22) Filed: Nov. 29, 2012

(65) Prior Publication Data

US 2013/0142636 A1 Jun. 6, 2013

(30) Foreign Application Priority Data

Dec. 1, 2011 (GB) ..... 1120675.2

(51) Int. Cl.

| | |
|---|---|
| ***F04D 19/00*** | (2006.01) |
| ***F04D 25/06*** | (2006.01) |
| ***F04D 25/02*** | (2006.01) |
| *F02B 39/10* | (2006.01) |

(52) U.S. Cl.

CPC ..... *F04D 19/00* (2013.01); *F04D 25/024* (2013.01); *F04D 25/0606* (2013.01); *F02B 39/10* (2013.01)

(58) Field of Classification Search

CPC ..... F04D 19/00; F04D 19/002; F04D 25/024; F04D 25/0606; F04D 25/00; F01D 25/14; F02D 39/10

USPC ..... 417/348, 380, 407; 416/198 A, 200 A, 416/201 R

See application file for complete search history.

(56) References Cited

U.S. PATENT DOCUMENTS

| | | | | |
|---|---|---|---|---|
| 1,475,485 | A * | 11/1923 | Gordon | 290/4 C |
| 2,173,489 | A * | 9/1939 | Voigt | 384/320 |
| 2,492,672 | A * | 12/1949 | Wood | 417/372 |
| 2,849,173 | A * | 8/1958 | Surdy | 417/203 |
| 4,924,674 | A * | 5/1990 | Hara | F01D 15/10 322/31 |
| 5,787,711 | A * | 8/1998 | Woollenweber et al. | 60/597 |
| 6,032,466 | A * | 3/2000 | Woollenweber et al. | 60/607 |
| 6,305,169 | B1 | 10/2001 | Mallof | |

(Continued)

FOREIGN PATENT DOCUMENTS

| | | |
|---|---|---|
| DE | 2610192 | 9/1977 |
| GB | 2354553 A | 3/2001 |

OTHER PUBLICATIONS

United Kingdom Search Report, dated Feb. 28, 2012, pp. 1-2, United Kingdom Application No. GB1120675.2, United Kingdom Intellectual Property Office.

*Primary Examiner* — Bryan Lettman
*Assistant Examiner* — Timothy Solak
(74) *Attorney, Agent, or Firm* — Taft Stettinius & Hollister LLP

(57) ABSTRACT

A turbocharger arrangement comprises a turbocharger and a generator. The turbocharger comprises a turbine having a turbine wheel and a compressor having a compressor wheel. The turbine wheel and the compressor wheel are mounted to a shaft, the shaft being supported by a bearing assembly located in a bearing housing between the turbine and the compressor, such that the shaft may rotate about an axis; The compressor wheel is between the generator and the bearing assembly; and an inducer portion of the compressor wheel is between an exducer portion of the compressor wheel and the bearing assembly.

7 Claims, 5 Drawing Sheets

(56) References Cited

U.S. PATENT DOCUMENTS

| | | | | |
|---|---|---|---|---|
| 6,739,845 | B2 * | 5/2004 | Woollenweber | F01D 15/10 384/448 |
| 6,792,755 | B2 * | 9/2004 | Arnold | F01D 5/048 415/102 |
| 7,025,579 | B2 * | 4/2006 | Woollenweber et al. | 417/407 |
| 2003/0223892 | A1 | 12/2003 | Woollenweber | |
| 2004/0200215 | A1 | 10/2004 | Woollenweber et al. | |
| 2004/0216458 | A1 | 11/2004 | Spooner | |
| 2006/0157410 | A1 * | 7/2006 | Hassan | 210/637 |
| 2008/0087018 | A1 | 4/2008 | Woollenweber | |
| 2009/0241773 | A1 * | 10/2009 | Lechnick et al. | 95/44 |
| 2010/0133183 | A1 * | 6/2010 | Theron et al. | 210/636 |
| 2011/0239648 | A1 | 10/2011 | Shiraishi | |

* cited by examiner

PRIOR-ART

PRIOR-ART

PRIOR-ART

AIR COOLING SYSTEM FOR A TURBOCHARGER DRIVEN GENERATOR

The present invention relates to a turbocharger arrangement. In particular, the present invention relates to a turbocharger arrangement having a turbocharger and a generator.

Turbochargers are well known devices for supplying air to an inlet of an internal combustion engine at pressures above atmospheric pressure (boost pressures). A conventional turbocharger essentially comprises an exhaust gas driven turbine wheel mounted on a rotatable shaft within a turbine housing connected downstream of an engine outlet manifold. Rotation of the turbine wheel rotates a compressor wheel mounted on the other end of the shaft within a compressor housing. The compressor wheel delivers compressed air to an engine inlet manifold. The turbocharger shaft is conventionally supported by journal and thrust bearings, including appropriate lubricating systems, located within a central bearing housing connected between the turbine and compressor wheel housings.

The turbine of a conventional turbocharger comprises: a turbine chamber within which the turbine wheel is mounted; an annular inlet defined between facing radial walls arranged around the turbine chamber; an inlet volute arranged around the annular inlet;

and an outlet passageway extending from the turbine chamber. The passageways and chamber communicate such that pressurized exhaust gas admitted to the inlet volute flows through the inlet to the outlet passageway via the turbine and rotates the turbine wheel. It is also known to improve turbine performance by providing vanes, referred to as nozzle vanes, in the inlet so as to deflect gas flowing through the inlet. That is, gas flowing through the annular inlet flows through inlet passages (defined between adjacent vanes) which induce swirl in the gas flow, turning the flow direction towards the direction of rotation of the turbine wheel.

Turbines may be of a fixed or variable geometry type. Variable geometry turbines differ from fixed geometry turbines in that characteristics of the inlet (such as the inlet's size) can be varied to optimise gas flow velocities over a range of mass flow rates so that the power output of the turbine can be varied to suit varying engine demands. For instance, when the volume of exhaust gas being delivered to the turbine is relatively low, the velocity of the gas reaching the turbine wheel is maintained at a level which ensures efficient turbine operation by reducing the size of the inlet using a variable geometry mechanism. Turbochargers provided with a variable geometry turbine are referred to as variable geometry turbochargers.

Nozzle vane arrangements in variable geometry turbochargers can take different forms. Two known types of variable geometry turbine are swing vane turbochargers and sliding nozzle turbochargers.

Generally, in swing vane turbochargers the inlet size (or flow size) of a turbocharger turbine is controlled by an array of movable vanes in the turbine inlet. Each vane can pivot about an axis extending across the inlet parallel to the turbocharger shaft and aligned with a point approximately half way along the vane length. A vane actuating mechanism is provided which is linked to each of the vanes and is displaceable in a manner which causes each of the vanes to move in unison, such a movement enabling the cross sectional area available for the incoming gas and the angle of approach of the gas to the turbine wheel to be controlled.

Generally, in sliding nozzle turbochargers the vanes are fixed to an axially movable wall that slides across the inlet.

The axially movable wall moves towards a facing shroud plate in order to close down the inlet and in so doing the vanes pass through apertures in the shroud plate. Alternatively, the nozzle ring is fixed to a wall of the turbine and a shroud plate is moved over the vanes to vary the size of the inlet.

The compressor of a conventional turbocharger comprises a compressor housing defining compressor chamber within which the compressor wheel is mounted such that it may rotate about an axis. The compressor also has a substantially axial inlet passageway defined by the compressor housing and a substantially annular outlet passageway defined by the compressor housing between facing radially extending walls arranged around the compressor chamber. A volute is arranged around the outlet passageway and an outlet is in flow communication with the volute. The passageways and compressor chamber communicate such that gas (for example, air) at a relatively low pressure is admitted to the inlet and is pumped, via the compressor chamber, outlet passageway and volute, to the outlet by rotation of the compressor wheel. The gas at the outlet is generally at a greater pressure (also referred to as boost pressure) than the relatively low pressure of the gas which is admitted to the inlet. The gas at the outlet may then be pumped downstream of the compressor outlet by the action of the compressor wheel.

Some known turbochargers are fitted with a generator such that rotation of the turbocharger rotor (turbine wheel, compressor wheel and shaft) when the turbocharger is in use can be used to generate electrical power.

Known turbochargers fitted with a generator suffer from significant thermal issues. Commonly, the operating performance of the generator is decreased when it is exposed to elevated operating temperatures. The turbine of a turbocharger is exposed to high temperatures because it is supplied with exhaust gases from the engine, in use. Heat from the turbine may be conducted along a portion of the turbocharger and/or generator such that heat travels from the turbine to the generator. This may cause the temperature of the generator to be elevated such that its operating performance is reduced.

It is possible to reduce the temperature within the bearing housing by providing the bearing housing with a cooling fluid, such as water or oil. This cooling fluid may be used to remove heat from the bearing housing. However, providing the bearing housing with a system to supply, distribute and remove cooling fluid may increase the complexity and cost of the turbocharger. Increasing the complexity of the turbocharger may mean that the turbocharger is less simple to assemble and therefore assembly time of the turbocharger may be increased.

In some situations, even with cooling fluid being supplied to the bearing housing, the temperature of the bearing housing may still be so high that the operating efficiency of the generator is still reduced.

It is an object of the present invention to provide a turbocharger arrangement which obviates or mitigates at least one of the above described disadvantages or other disadvantages present in the prior art.

According to the present invention there is provided a turbocharger arrangement comprising a turbocharger and a generator; the turbocharger comprising a turbine having a turbine wheel and a compressor having a compressor wheel; the turbine wheel and the compressor wheel being mounted to a shaft, the shaft being supported by a bearing assembly located in a bearing housing between the turbine and the compressor, such that the shaft may rotate about an axis;

wherein, the compressor wheel is between the generator and the bearing assembly; and wherein an inducer portion of the compressor wheel is between an exducer portion of the compressor wheel and the bearing assembly.

The compressor may have an inlet and an outlet, wherein the inlet is axially inboard of the compressor wheel.

The inlet may have a first end adjacent the compressor wheel and a second end remote from the compressor wheel, and wherein the inlet is defined by a wall, a portion of the wall defining the first end of the inlet is generally parallel to the axis, such that, in use, gas flowing through the first end of the inlet flows in a direction generally parallel to the axis.

A portion of the wall may define the second end of the inlet is generally radial with respect to the axis, such that, in use, gas flowing through the second end of the inlet flows in a generally radial direction with respect to the axis.

The shaft may have a plurality of discrete shaft portions which are joined to one another.

A portion of the compressor wheel may be attached directly to a portion of the generator.

The portion of the compressor wheel which may be attached a portion of the generator is a portion of a back face of the compressor wheel.

The outlet of the compressor may comprise a substantially annular outlet passageway and a volute arranged around the outlet passageway.

The compressor wheel may be housed in a compressor housing, the turbine wheel is housed in a turbine housing and the generator is housed in a generator housing.

The compressor housing and generator housing may be of one-piece construction.

The bearing housing and compressor housing may be of one-piece construction.

A specific embodiment of the present invention will now be described, by way of example only, with reference to the accompanying drawings, in which.

Figure 1:
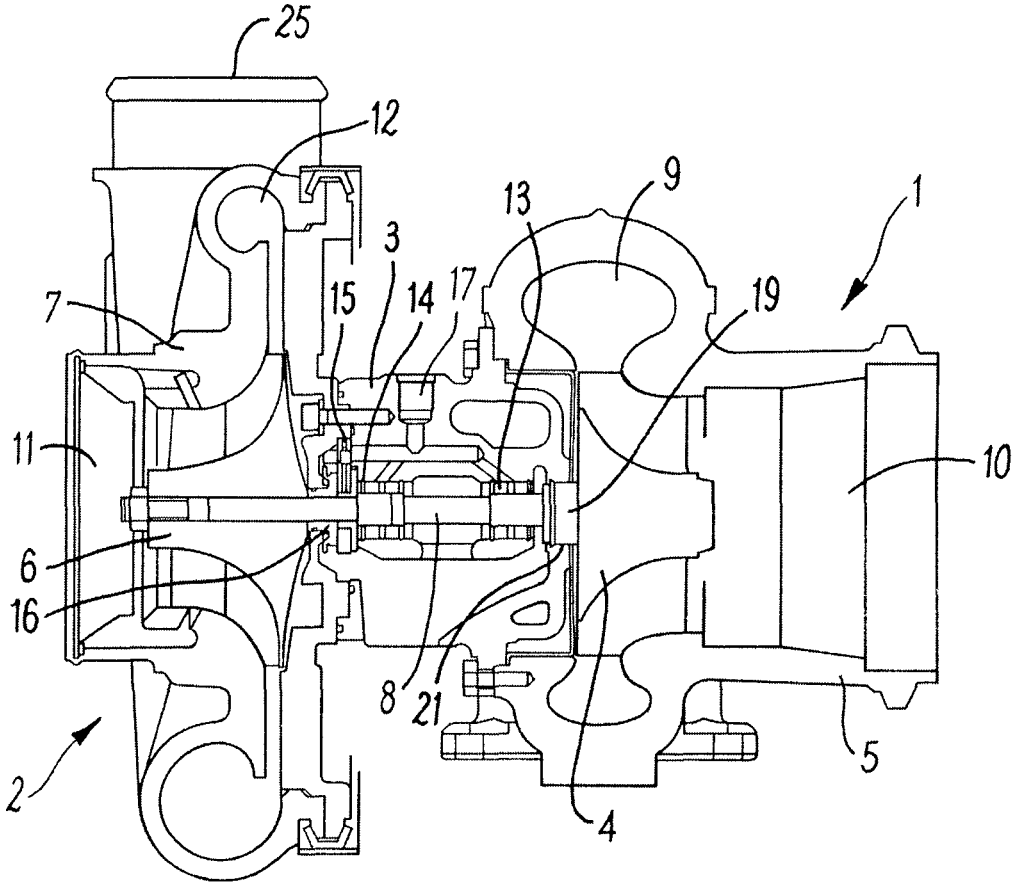
FIG. 1 shows a cross-sectional view of a turbocharger.

Referring to FIG. 1, the turbocharger comprises a turbine 1 joined to a compressor 2 via a central bearing housing 3. The turbine 1 comprises a turbine wheel 4 for rotation within a turbine housing 5. Similarly, the compressor 2 comprises a compressor wheel 6 which can rotate within a compressor housing 7. The compressor housing 7 defines compressor chamber within which the compressor wheel 6 can rotate. The turbine wheel 4 and compressor wheel 6 are mounted on opposite ends of a common turbocharger shaft 8 which extends through the central bearing housing 3.

The turbine housing 5 has an exhaust gas inlet volute 9 located annularly around the turbine wheel 4 and an axial exhaust gas outlet 10. The compressor housing 7 has an axial air intake passage 11 and a volute 12 arranged annularly around the compressor chamber. The volute 12 is in gas flow communication with a compressor outlet 25. The turbocharger shaft 8 rotates on journal bearings 13 and 14 housed towards the turbine end and compressor end respectively of the bearing housing 3. The compressor end bearing 14 further includes a thrust bearing 15 which interacts with an oil seal assembly including an oil slinger 16. Oil is supplied to the bearing housing from the oil system of the internal combustion engine via oil inlet 17 and is fed to the bearing assemblies by oil passageways 18. The oil fed to the bearing assemblies may be used to both lubricate the bearing assemblies and to remove heat from the bearing assemblies. The heating of the bearing assemblies may be caused by at least one of the following processes: friction due to rotation of the shaft, heat transferred from the turbine to the bearing assemblies via the bearing housing, and heat transferred to the bearing assemblies via the shaft 8. Other known turbochargers may use other types of bearing to support the turbocharger shaft within the turbocharger. For example, rolling element bearings may be used instead of journal bearings.

Figure 6:
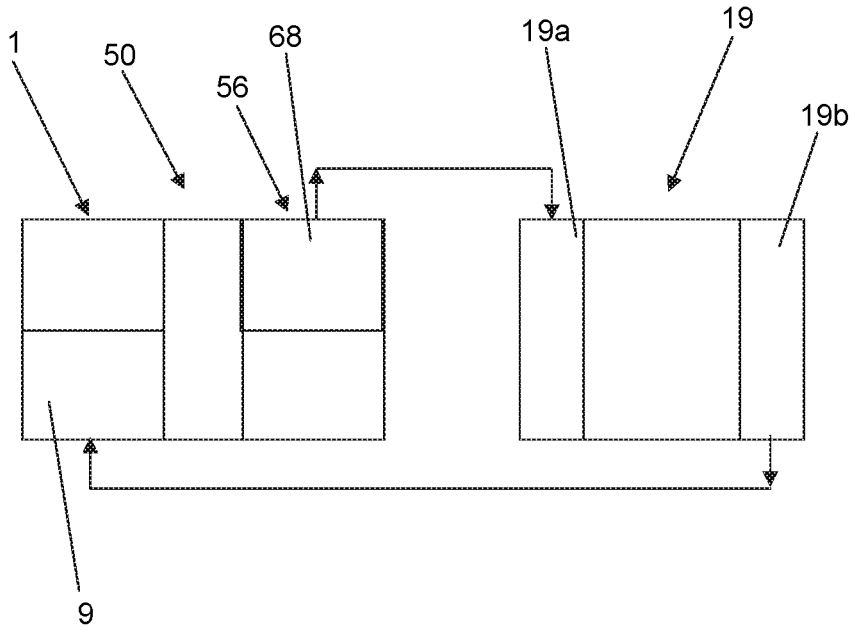
FIG. 6 shows a schematic of an engine system.

In use, the turbine wheel 4 is rotated by the passage of exhaust gas from an outlet 19*b* of an internal combustion engine 19 to the annular exhaust gas inlet 9 to the exhaust gas outlet 10. The turbine wheel 4 in turn rotates the compressor wheel 6 which thereby draws intake air through the compressor inlet 11 and delivers boost air to the intake 19*a* of internal combustion engine 19 (FIG. 6) via the volute 12 and then the outlet 25.

Figure 2:
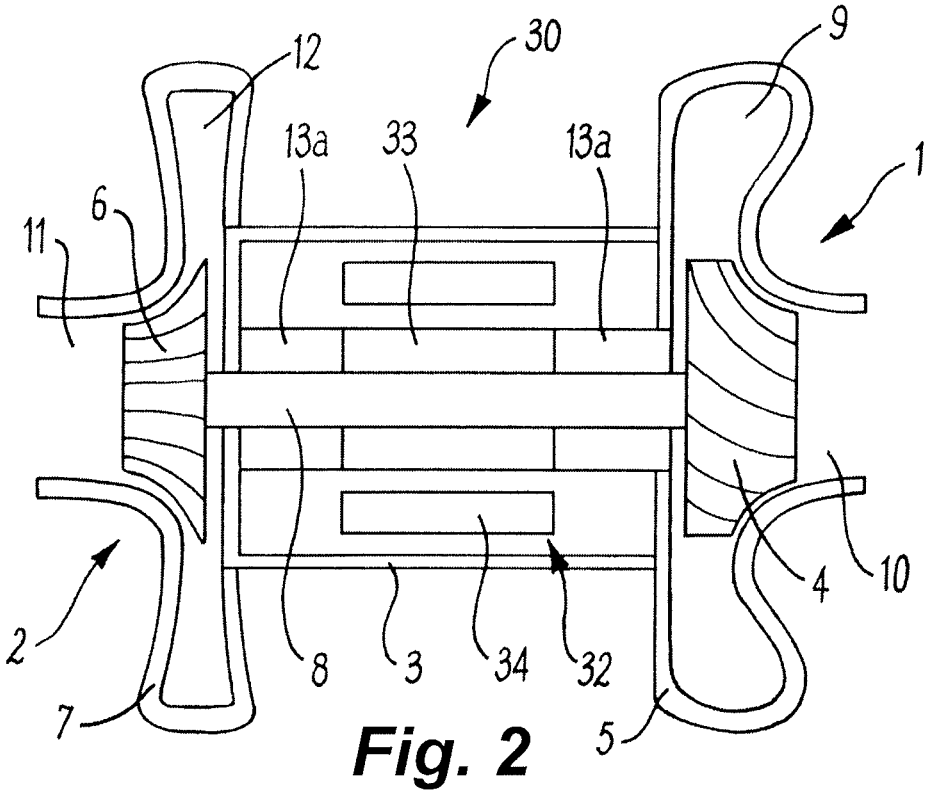
FIG. 2 shows a schematic cross-sectional view of a first known turbocharger arrangement having a turbocharger and a generator.
Figure 3:
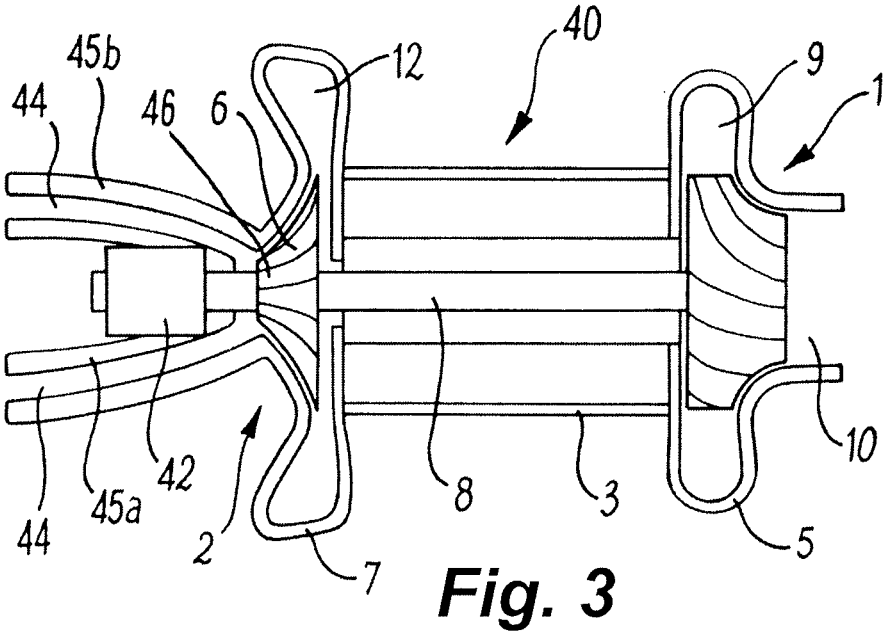
FIG. 3 shows a schematic cross-sectional view of a second known turbocharger arrangement having a turbocharger and a generator.

Some known turbocharger arrangements incorporate a turbocharger and a generator. FIGS. 2 and 3 each show a schematic representation of a different known turbocharger arrangement having a turbocharger and a generator.

The turbocharger arrangement 30 shown in FIG. 2 is very similar to the turbocharger shown in FIG. 1.

Features of the turbocharger arrangement 30 shown in FIG. 2 which are substantially similar to those shown in the turbocharger of FIG. 1 have been numbered with the same reference numerals.

The turbocharger shown in FIG. 2 differs from that shown in FIG. 1 in that the bearing housing 3 not only houses bearing assemblies 13A which support the shaft 8, but also a generator indicated generally by 32.

The generator 32 comprises a rotor portion 33 which is linked to the shaft 8 so that it rotates therewith, and a stator portion 34 which is fixed with respect to the bearing housing.

The generator 32 is of conventional construction, wherein one of the rotor portion 33 or stator portion 34 comprises the armature portion of the generator, which is the power producing portion of the generator; and the other of the rotor or stator comprises a field portion of the generator, which is the portion of the generator that produces a magnetic field. Rotation of the rotor portion 33 relative to the stator portion 34 due to the rotation of the shaft 8 causes the generator 32 to produce electrical power.

Due to the fact that the generator 32 is mounted in the bearing housing 3, which is adjacent to the turbine 1, the operating performance of the generator 32 can be adversely affected. This is because the turbine 1 is supplied with exhaust gases from the engine at relatively high temperatures. These exhaust gases cause the turbine housing 5 and turbine wheel 4 of the turbine 1 to be heated. As such, when the turbocharger arrangement 30 is in use, the turbine housing 5 and turbine wheel 4 are at a relatively high temperature. For example, the turbine housing 5 and turbine wheel 4 may be at a temperature of between about 600 degrees Celsius and 900 degrees Celsius.

Heat from the turbine housing 5 and turbine wheel 4 are transmitted to the generator 32 via either the bearing housing or the shaft 8. Increasing the temperature of the generator 32 may decrease the operating performance of the generator for various reasons, including an increase in resistance of the armature portion of the generator. Heat is also transmitted to the generator 32 via the bearing assemblies 13A due to frictional heat generated by the rotation of the shaft 8 within the bearing assemblies 13A.

It follows that the turbocharger arrangement shown in FIG. 2 has a generator which is adversely affected by heat transmitted from the turbine into the bearing housing, and/or due to frictional heat generated by the bearing assemblies. Some known turbocharger arrangements similar to that shown in FIG. 2 incorporate additional cooling so as to reduce the temperature of the bearing housing (and hence the generator) in order to attempt to improve the operating performance of the generator. This additional cooling may be provided by a water cooling system or by increasing the flow of oil to the bearing housing. Although oil is provided to the bearing housing primarily for lubricating the bearing arrangements, the oil also cools components within the bearing housing (including the generator). The provision of additional cooling may add to the complexity and/or cost of the turbocharger arrangement, which may be undesirable.

FIG. 3 shows a further known turbocharger arrangement 40. Again, features of the turbocharger arrangement 40 shown in FIG. 3 which are substantially similar to those of the turbocharger shown in FIG. 1 are given the same numbering as those features of the turbocharger shown in FIG. 1. The turbocharger arrangement 40 shown in FIG. 3 differs from the turbocharger shown in FIG. 1 in that it has a generator 42 which is located axially (i.e. along the axis of rotation of the turbocharger) outboard of the compressor wheel 6. When describing the location of the generator as axially outboard of the compressor wheel, what is meant is that the generator 42 is located at a position which has an axial distance from the turbine wheel 4 which is greater than the axial distance between the turbine wheel 4 and the compressor wheel 6.

The generator 42 is connected to the shaft 8. In the turbocharger arrangement 40 shown in FIG. 3, the turbine wheel 4, compressor wheel 6 and generator 42 are all mounted to a single shaft.

In order to provide the compressor 2 of the turbine arrangement 40 with air, the turbocharger arrangement comprises a generally annular air inlet passageway 44. The generally annular air inlet passageway is defined between a radially inner wall 45*a* and a radially outer wall 45*b*. Struts (not shown) extend between the radial inner wall 45*a* and radially outer wall 45*b* so as support the walls 45*a*, 45*b* relative to one another. The inlet passageway 44 is open at a first end. The inlet passageway 44 extends around the generator 42 such that it opens at a second end onto an inducer portion 46 of the compressor wheel 6. The first and second ends of the passageway 44 extend in a direction generally parallel to the axis of rotation of the turbocharger.

Locating the generator axially outboard of the compressor wheel reduces the heat that the generator is exposed to compared to if the generator is located in the bearing housing. This is because the compressor (which is adjacent the generator in this turbocharger arrangement) is supplied with relatively cool air from the atmosphere. In some cases, the movement of relatively cool air (for example from the atmosphere) flowing through the compressor may extract heat from the turbocharger arrangement and thus reduce the temperature of at least part of the turbocharger arrangement, in particular the generator. Furthermore, as previously discussed, the turbine (which in this turbocharger arrangement is at the opposite end of the turbocharger arrangement compared to the generator) is supplied with air at a high temperature due to the turbine being supplied with exhaust gas from the engine to which the turbocharger is attached. In this turbocharger arrangement, because the turbine is located at the opposite end of the turbocharger arrangement compared to the generator, the heat transferred from the turbine to the generator is minimised. For example, by locating the generator axially outboard of the compressor, the path along which heat has to travel if it is to be conducted from the turbine to the generator is greater in the case if this turbocharger arrangement compared to if the generator is located in the bearing housing. It follows that the amount of heat which is conducted from the turbine to the generator is reduced when the generator is located axially outboard of the compressor.

Although locating the generator axially outboard of the compressor reduces the heat which the generator is exposed to (which may in turn result in an improved operating performance of the generator), locating the generator in this way has disadvantages.

As previously discussed, it is common for the compressor of a turbocharger to be configured such that is has a substantially axial inlet. This may be problematic in a case where the generator is located axially outboard of the compressor. This is because the generator is located on the axis of the turbocharger axially outboard of the compressor wheel, exactly where the compressor inlet would otherwise be located. In order to overcome this problem the turbocharger incorporate an inlet passageway 44 which passes between the generator and the compressor. Due to the fact that the inlet passageway passes between the generator and the compressor the generator is located further from the bearing housing than would otherwise be necessary. It follows that the turbocharger (incorporating the generator) is longer than would otherwise be necessary.

The turbocharger arrangement 40 shown in FIG. 3 has several further disadvantages.

First, by locating the generator arrangement 42 axially outboard of the compressor wheel 6 and by the inclusion of the inlet passageway 44, the turbocharger arrangement has a greater axial length (and therefore a greater size) than a standard turbocharger without a generator arrangement located axially outboard of the compressor. Furthermore, the use of additional material in order to make the inlet passageway 44 will increase the overall weight of the turbocharger arrangement 40 compared to a turbocharger without a generator and said inlet passageway. In some applications of a turbocharger arrangement having a generator, the maximum possible size and/or weight of the turbocharger arrangement may be limited and, as such, in these situations, the turbocharger arrangement shown in FIG. 3 may be disadvantageous.

Secondly, the location of the generator 42 axially outboard of the compressor 2 increases the mass overhang of the compressor end of the shaft 8. The mass overhang of the compressor end of the shaft 8 is function of the product of the mass axially outboard of the bearing assembly (the mass of the compressor wheel, the rotor of the generator, and the portion of the shaft which extends beyond the bearing arrangement within the bearing housing closest to the compressor), and the distance between the bearing assembly and the point at which the mass axially outboard of the bearing assembly can be considered to act.

Increased mass overhang of the compressor end of the shaft 8 results in the requirement for a thicker shaft. This is because a thicker shaft is required to overcome shaft bending and various bearing and/or oil-film vibration modes which are associated with a greater mass overhang. Increasing the thickness of the shaft results in the shaft being heavier and more costly to produce. The increased weight of the shaft leads to an increased weight of the turbocharger arrangement which may be undesirable in certain applications. Furthermore, the use of a thicker shaft requires the use of larger bearings within the bearing assemblies that support the shaft. These bearings may again be heavier and more costly to produce. In addition, larger bearings tend to be less efficient, thereby generating greater amounts of heat and causing greater frictional losses.

Furthermore, the use of a thicker shaft may result in greater conduction of heat from the bearing arrangement within the bearing housing to the compressor and generator. Increased conduction of heat from the turbine to the bearing arrangement may necessitate greater cooling requirements of the bearing assembly. For example, more cooling oil or cooling water may need to be supplied to the bearing arrangement. This increases the operational demands of the turbocharger arrangement. Furthermore, if heat is conducted from the turbine to the compressor and/or generator, then this may lead to a reduction in the operating performance of the compressor and/or generator.

Figure 4:
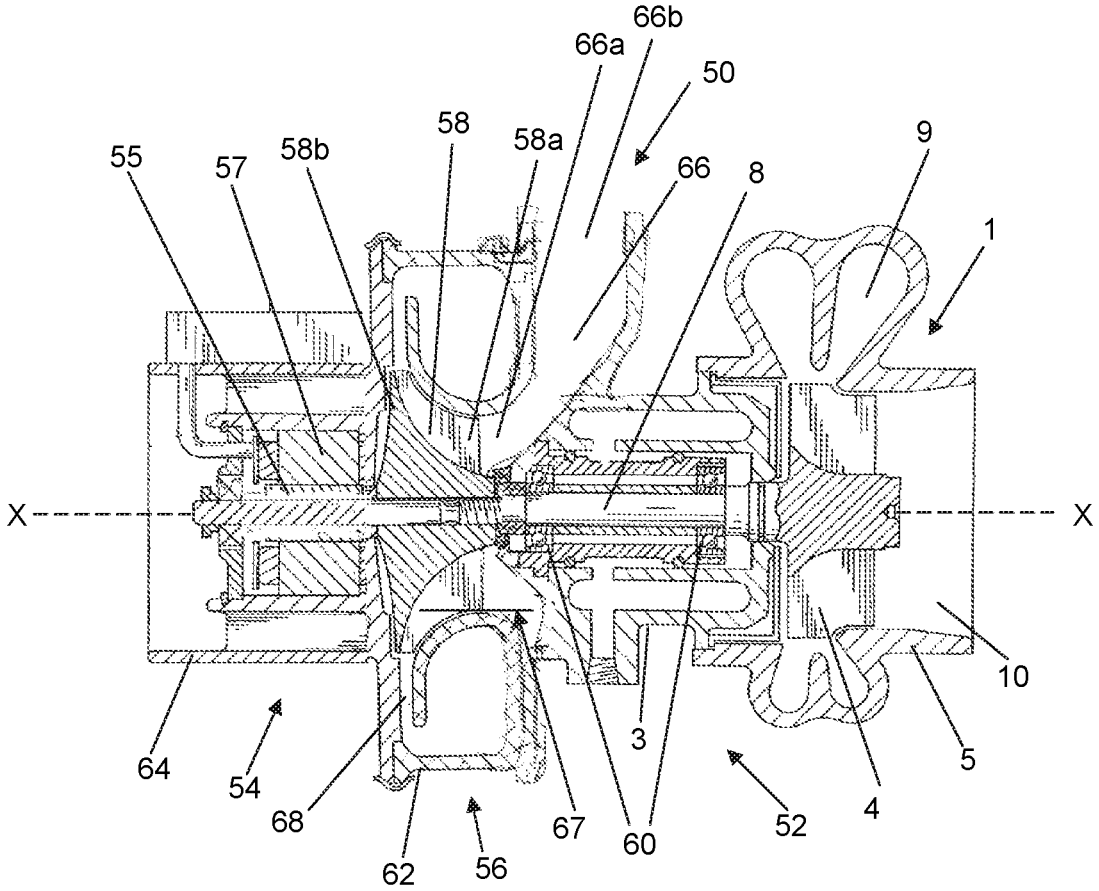
FIG. 4 shows a schematic cross-sectional view of an embodiment of the present invention.

FIG. 4 shows a turbocharger arrangement 50 according to an embodiment of the present invention. Features of the turbocharger arrangement 50 which are substantially similar to those of the turbocharger shown in FIG. 1 have been numbered using numbering which corresponds to that of the features of the turbocharger shown in FIG. 1.

The turbocharger arrangement 50 comprises a turbocharger 52 and a generator 54. The turbocharger 52 comprises a turbine 1 having a turbine wheel 4, and a compressor 56 having a compressor wheel 58. The turbine 1 is joined to the compressor 56 via a central bearing housing 3. The turbine wheel 4 and compressor wheel 58 are mounted to a shaft 8. The turbocharger shaft 8 rotates on two bearing assemblies 60 within the bearing housing 3. The turbine wheel 4 rotates within the turbo housing 5. Similarly, the compressor wheel 58 rotates within a compressor chamber defined by a compressor housing 62.

The turbine housing 5 defines an exhaust gas inlet volute 9 arranged around an annular inlet which is in turn arranged around the turbine wheel 4. The turbine housing also defines an axial exhaust gas outlet 10.

As previously discussed, the turbine wheel 4 and compressor wheel 58 are mounted to the shaft 8. The shaft 8 is supported by at least one bearing assembly 60 located in the bearing housing 3 intermediate the turbine 1 and the compressor 56, such that the shaft 8 may rotate about an axis x-x. The axis x-x about which the shaft (and attached turbine wheel 4 and compressor wheel 58 rotate) may also be referred to as the turbocharger axis.

The generator 54 is located axially outboard of the compressor 56. That is to say, the generator 54 is located at a position such that the axial distance between the generator 54 and the turbine is greater than the axial distance between the compressor 56 and the turbine 1. The generator 54 has a generator housing 64 which depends from the compressor housing 62. The generator 54 has a rotor portion 55 which is mounted to the shaft 8 such that the rotor portion 55 of the generator 54, the compressor wheel 58, the turbine wheel 4 and the shaft 8 all co-rotate. The generator 54 also has a stator portion 57 which is fixed relative to the generator housing 64. The generator 54 operates in a conventional manner whereby rotation of the rotor portion 55 relative to the stator portion 57 of the generator 54 generates electrical power.

The compressor wheel 58 is mounted on the shaft 8 such that it is between the generator 54 and the at least one bearing assembly 60 within the bearing housing 3. The compressor wheel 58 has an inducer portion 58*a* and an exducer portion 58*b*. The inducer portion 58*a* of the compressor wheel 58, when in use, receives air from a compressor intake 66. The air from the compressor inlet 66 then passes from adjacent the inducer portion 58*a* of the compressor wheel 58 to adjacent the exducer portion 58*b* of the compressor wheel. The air is then passed from the adjacent exducer portion of the compressor wheel to a compressor outlet 68. In this case the compressor outlet 68 is generally radial. That is to say, gas passing out of the compressor outlet 68 in use travels in a generally radially outward direction relative to the turbocharger axis.

The compressor wheel 58 is mounted to the shaft 8 such that the inducer portion of the compressor wheel 58*a* is between the exducer portion 58*b* of the compressor wheel 58 and the at least one bearing assembly 60 within the bearing housing 3. As such, it may also be said that the inducer portion of the compressor wheel 58*a* is between the exducer portion 58*b* of the compressor wheel 58 and the bearing housing 3. This arrangement of the compressor wheel 58 within the present invention is different to the arrangement of a conventional compressor wheel (such as one shown in FIGS. 1 to 3). Conventional compressor wheels are generally arranged such that the exducer portion of the compressor wheel is between the inducer portion of the compressor wheel and the at least one bearing assembly.

The compressor inlet 66 feeds into the compressor 56 from a position axially inboard of the compressor 56. That is to say, the compressor inlet 66 feeds into the compressor 56 from the turbine side of the compressor 56. In other words, the axial distance between the inlet 66 and the turbine 1 is less than the distance between compressor wheel and the turbine 1. It may also be said that the compressor inlet 66 feeds into the compressor 56 from the bearing housing 3 side of the compressor 56.

The embodiment of a turbocharger arrangement according to the present invention shown in FIG. 4 has a compressor inlet 66. The compressor inlet 66 has a first end 66*a* adjacent the compressor wheel 58 (and in particular, the inducer portion 58*a* of the compressor wheel 58) and a second end 66*b* remote from the compressor wheel 58. The inlet may be generally volute shaped. The generally volute shaped inlet may induce swirl (which may also be referred to as pre-swirl) into the gas as it travels through the inlet. Introducing pre-swirl into the gas before it is interacts with the compressor wheel may increase the efficiency of the compressor (i.e. increase the proportion of the energy of the gas which is supplied to the compressor which is converted into useful work by the compressor) and thereby increase the efficiency and operating performance of the turbocharger.

The first end of the compressor inlet 66 is orientated such that, in use, the direction of flow of gas through the first end of the compressor inlet 66 has a component which is substantially parallel to the turbocharger axis. In other words, the flow of gas through the first end of the compressor inlet 66 has a component which is in a generally axial direction. The compressor inlet 66 is defined by a wall. A portion of the wall defining the first end of the compressor inlet 66 includes a tangent 67 that runs in a direction which is (or a component of which is) substantially parallel to the turbocharger axis (which may be referred to as a generally axial direction). That is to say that the first end of the compressor inlet 66 is orientated such that, in use, the direction of flow of gas through the first end of the compressor inlet 66 has a component which is non-perpendicular to the turbocharger axis and the portion of the wall defining the first end of the compressor inlet 66 runs in a direction which is non-perpendicular to the turbocharger axis.

The second end of the compressor inlet 66 is orientated such that, in use, the direction of flow of gas through the second end of the compressor inlet 66 is substantially perpendicular to the turbocharger axis. The portion of the wall defining the second end of the compressor inlet 66 runs in a direction which is substantially perpendicular to the turbocharger axis. An intermediate portion of the compressor inlet 66 joins the first and second ends of the compressor inlet 66.

It will be appreciated that any suitable configuration of compressor inlet may be used. For example, in some embodiments of the invention, the first end of the compressor inlet may be orientated such that in use, the direction of flow of gas through the first end of the compressor inlet is substantially parallel to the turbocharger axis; and the second end of the compressor inlet may be orientated such that in use, the direction of flow of gas through the second end of the compressor inlet is non-parallel to the turbocharger axis.

The arrangement of the turbocharger arrangement 50 and, in particular, of the compressor wheel 58—according to the present invention—has several advantages. This are discussed below.

The generator 54 is located axially outboard of the compressor 56. This means that the generator 54 is located as far as possible away from the turbine 1 and bearing housing 3, both of which, in use, are exposed to high temperatures due to the inflow of exhaust gases, and/or experience frictional heating. By locating the generator 54 as far away from the turbine 1 and bearing housing 3 as possible, the amount of heat transmitted to the generator 54 from the turbine and/or bearing housing is minimised, thus improving the operating performance of the generator 54.

Figure 5:
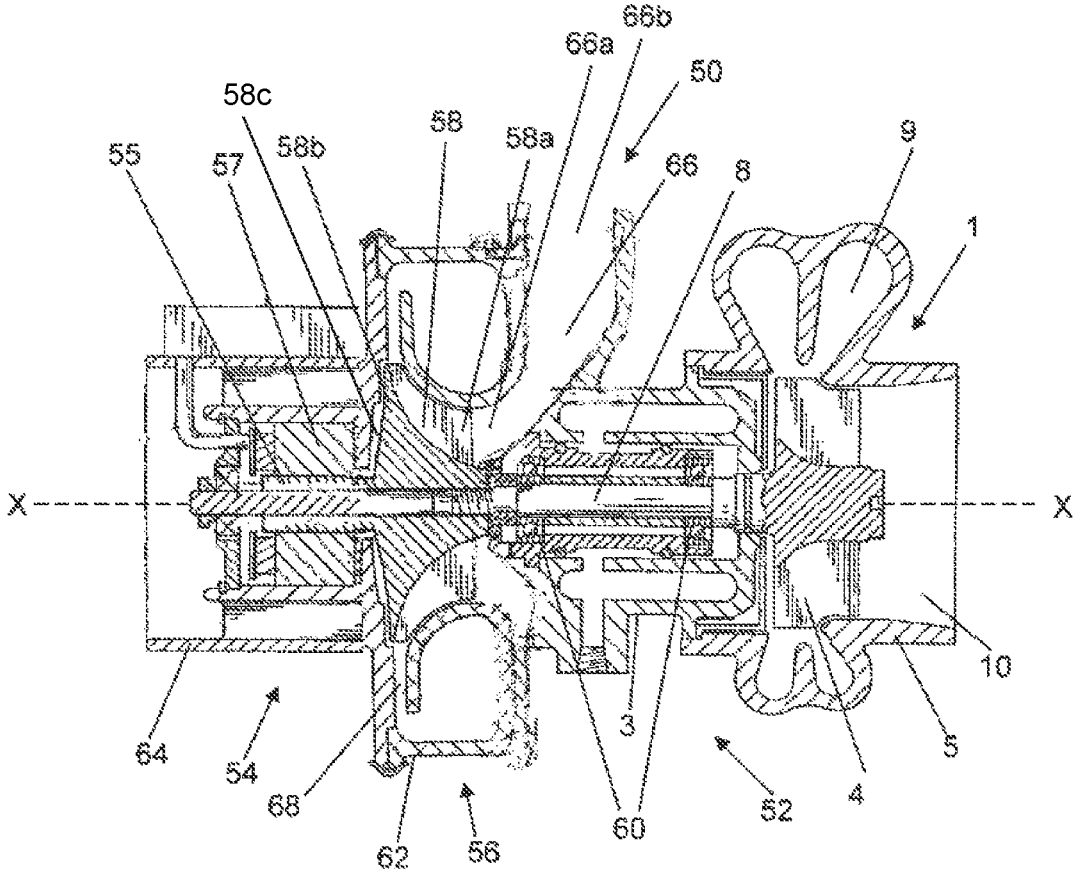
FIG. 5 shows a schematic cross-sectional view of an embodiment of the invention.

The arrangement of the compressor wheel 58 whereby the exducer portion 58*b* is axially outboard of the inducer portion 58*a* enables the generator to be located very close to the compressor and, in particular, the compressor wheel. In some embodiments, a portion of the compressor wheel (such as a back face 58*c* of the compressor wheel shown in FIG. 5) may be attached directly to a portion of the generator. This may reduce the overall length of the turbocharger arrangement. The back face of a compressor wheel is a surface of the compressor wheel which may be generally radial and which is located at the exducer end of the compressor wheel. The back face of the compressor wheel faces away from the inducer portion of the compressor wheel and is generally free from compressor blades.

For example, if the embodiment of the present invention shown at FIG. 4 is compared to the prior art turbocharger arrangement shown in FIG. 3, it can be seen that in the known turbocharger arrangement shown in FIG. 3 the generator 42 must be spaced from the compressor 2 so that the inlet passageways 44 can pass around the generator 42 (and between the generator 42 and the compressor 2) so that the inlet passageways 44 open onto the axial inlet of the compressor 2. By eliminating the spacing between the generator 42 and the compressor 2 required to accommodate the inlet passageways 44 the overall length of the turbocharger arrangement is reduced. This may be advantageous in application where space is limited.

Reducing or eliminating the spacing between the compressor 56 and generator 54 reduces the mass overhang of the compressor end of the rotating portion of the turbocharger arrangement (i.e., in this case, the compressor wheel 58, the rotor portion of the generator 54 and the portion of the shaft which extends beyond the bearing arrangement closest to the compressor wheel 58 that supports the shaft). By reducing the mass overhang at the compressor end of the turbocharger arrangement a thinner shaft can be used (compared to a similar turbocharger arrangement with a greater mass overhang). The use of a thinner diameter shaft has several benefits. First, the shaft will be lighter and less expensive to produce. Secondly, the thinner the shaft, the smaller the size of the bearings that can be used within the at least one bearing arrangement used to support the shaft. Smaller bearings tend to be both cheaper and more efficient than their larger counterparts. Smaller bearings tend to generate less heat due to friction compared to their larger counterparts.

The arrangement of the compressor wheel 58 of the present invention would be counterintuitive to a person skilled in the art. One reason for this is that if the compressor wheel is arranged such that the exducer portion 58*b* is axially outboard of the inducer portion 58*a*, and because if the current compressor housing structure were maintained, then air would have to be supplied to the compressor wheel via a radial inlet (i.e. via an inlet in which the gas supplied to the compressor meets the compressor wheel whilst travelling in a generally radial direction). In this case, there may be a reduction in the efficiency of the compressor. If, instead, the compressor inlet was maintained as an axial inlet from the axially outboard side of the compressor (as shown in FIG. 3), but the compressor wheel is reversed (i.e. exducer axially outboard of inducer), then there may be a reduction in compressor performance to the extent that the compressor does not function.

A further reason why the arrangement of the compressor wheel 58 of the present invention would be counterintuitive to a person skilled in the art is that, by arranging the compressor inlet 66 such that it is axially inboard of the compressor wheel, the gas entering the compressor via the compressor inlet will be exposed to a greater amount of heat (e.g. from the bearing housing) compared to if the compressor inlet were configured such that it is axially outboard of the compressor wheel. Exposing the gas entering the compressor via the compressor inlet to heat may increase the temperature of the gas entering the compressor and thereby reduce the performance of the turbocharger.

It will be appreciated that any suitable shaft configuration may be used in order to secure the turbine wheel for compressor wheel 58 and rotor portion of the generator 54 together. In the embodiment of the invention shown in FIG. 4, a single shaft is used to secure the turbine wheel, compressor wheel and rotor portion of the generator together. In other embodiments a plurality of separate shaft portions may be used which can be secured to one another. Furthermore, any appropriate fastening method may be used to secure the turbine wheel, compressor wheel or generator rotor portion to the shaft or shaft portions.

It will be appreciated that any appropriate construction of the generator housing 64, compressor housing 62 and bearing housing 3 may be used. For example, the generator housing, compressor housing and bearing housing may be formed as separate pieces. Alternatively, at least two of the bearing housing, the compressor housing and the generator housing may be formed as one piece. Any interface between the bearing housing and the compressor housing, or between the compressor housing and the generator housing, may be secured together using any appropriate fastening method.

The compressor outlet 68 may be defined by the compressor housing alone, or a combination of the compressor housing and the bearing housing. Similarly, the compressor inlet 66 may be defined by the compressor housing alone or by a combination of the compressor housing and the bearing housing.

The invention claimed is:

1. An engine system comprising an internal combustion engine and a turbocharger arrangement, the turbocharger arrangement comprising:

a turbocharger and a generator;

the turbocharger comprising a turbine having a turbine wheel and a compressor having a compressor wheel;

the turbine wheel and the compressor wheel being mounted to a shaft, the shaft being supported by a bearing assembly located in a bearing housing between the turbine and the compressor, such that the shaft may rotate about an axis;

wherein, the compressor wheel is between the generator and the bearing assembly; and wherein an inducer portion of the compressor wheel is between an exducer portion of the compressor wheel and the bearing assembly;

wherein a back face of the compressor wheel is in direct contact with a portion of the generator;

wherein the compressor has an inlet and an outlet, wherein the inlet is axially inboard of the compressor wheel;

wherein the outlet of the compressor comprises a annular outlet passageway and a volute arrangement around the outlet passageway; and wherein the outlet of the compressor is in communication with an inlet of the internal combustion engine so as to provide compressed air to the internal combustion engine;

wherein the inlet has a first end adjacent the compressor wheel and a second end remote from the compressor wheel; and wherein a portion of a wall defining the second end of the inlet is radial with respect to the axis, such that, in use, gas flowing through the second end of the inlet flows in a radial direction with respect to the axis.

2. The engine system according to claim 1, wherein the inlet is defined by the wall, a tangent to a portion of the wall defining the first end of the inlet being parallel to the axis, such that, in use, gas flowing through the first end of the inlet flows in a direction parallel to the axis.

3. The engine system according to claim 1, wherein the shaft has a plurality of discrete shaft portions which are joined to one another.

4. The engine system according to claim 1, wherein the compressor wheel is housed in a compressor housing, the turbine wheel is housed in a turbine housing and the generator is housed in a generator housing.

5. The engine system according to claim 4, wherein the compressor housing and generator housing are of one-piece construction.

6. The engine system according to claim 4, wherein the bearing housing and compressor housing are of one-piece construction.

7. The engine system according to claim 1, wherein an inlet of the turbine is in communication with an outlet of the internal combustion engine such that the turbine is drivable by exhaust gas from the internal combustion engine.

* * * * *